US006305091B1

(12) United States Patent
Tegels

(10) Patent No.: US 6,305,091 B1
(45) Date of Patent: Oct. 23, 2001

(54) MARKING GUIDE JIG APPARATUS FOR, AND METHOD OF, MARKING OF WOOD TRIM FOR SUBSEQUENT MITER CUT OF WINDOW/DOOR OPENING TRIM

(76) Inventor: Arvel D. Tegels, 2231 2nd St., Eau Claire, WI (US) 54703

( * ) Notice: Subject to any disclaimer, the term of this patent is extended or adjusted under 35 U.S.C. 154(b) by 0 days.

(21) Appl. No.: 09/565,050

(22) Filed: May 5, 2000

(51) Int. Cl.[7] ..... E04F 21/00; E06B 3/00

(52) U.S. Cl. ..... 33/194; 33/562; 33/563; 33/566; 269/97; 269/43; 269/904; 269/45; 269/95

(58) Field of Search ..... 269/97, 43, 904, 269/45, 95; 33/194, 562, 563, 566

(56) References Cited

U.S. PATENT DOCUMENTS

| | | | |
|---|---|---|---|
| 3,753,556 | 8/1973 | Nix | 269/97 |
| 4,308,692 | 1/1982 | Rumble et al. | 49/504 |
| 4,556,205 | 12/1985 | Rock et al. | 269/2 |
| 4,793,109 | 12/1988 | Noach | 52/211 |
| 5,088,682 | 2/1992 | Gibbs | 248/542 |
| 5,305,566 | 4/1994 | Larkowski | 52/211 |
| 5,669,192 | 9/1997 | Opdyke et al. | 52/211 |

*Primary Examiner*—Carl D. Friedman
*Assistant Examiner*—Chi Nguyen
(74) *Attorney, Agent, or Firm*—Robert T. Johnson

(57) ABSTRACT

Double end and single end jig apparatus is disclosed having a channel and guide edges for marking window/door trim held in the channel, for subsequent miter cut of corners for mounting the trim around window/door opening, and a set back or margin between the window/door opening and the trim.

6 Claims, 4 Drawing Sheets

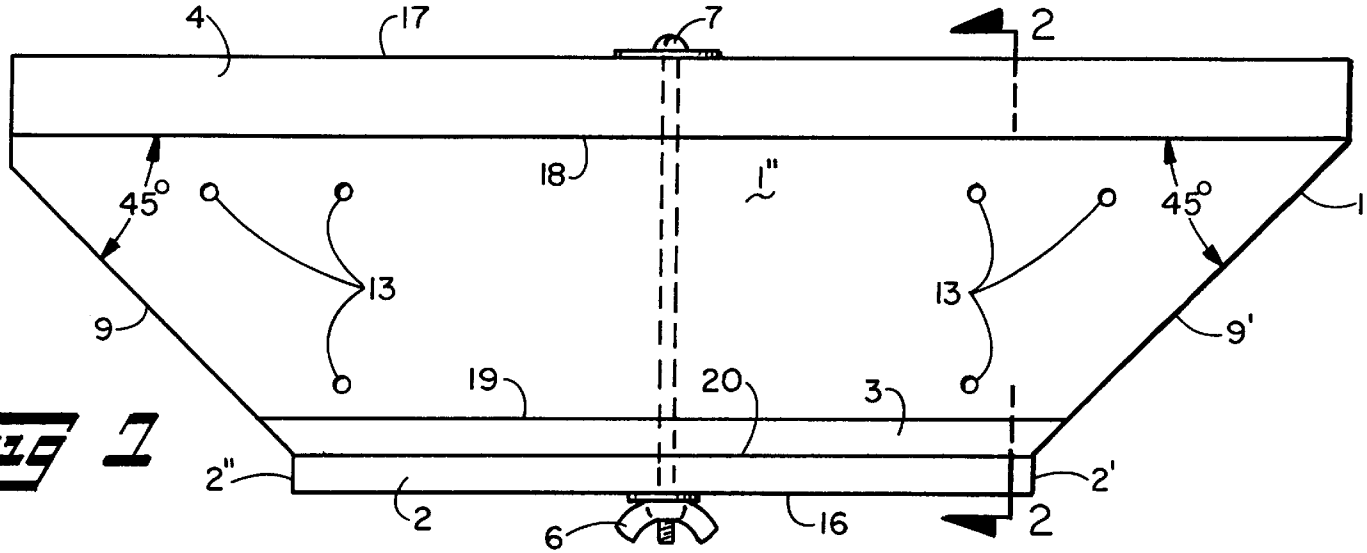
FIG 1
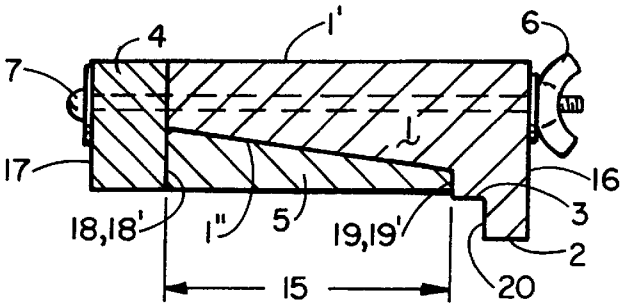
FIG 4
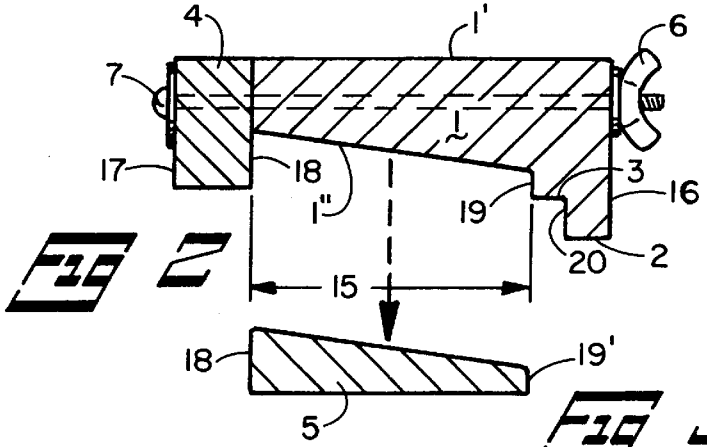
FIG 2
FIG 3

MARKING GUIDE JIG APPARATUS FOR, AND METHOD OF, MARKING OF WOOD TRIM FOR SUBSEQUENT MITER CUT OF WINDOW/DOOR OPENING TRIM

BACKGROUND OF THE INVENTION

Installing window and door trim requires care in making the miter cuts at the corners, and further the set back of the trim from the edge of the opening requires care in order to have uniform mounting of the trim boards.

This present invention discloses jig guide apparatus for marking or scribing trim board for subsequent corner miter cuts of the trim board, and to have a uniform set back of the trim board from the window or door opening, on all sides of a window/door opening.

SUMMARY OF THE INVENTION

This invention is for jig apparatus for and method of guiding a mark line or scribing on wood trim, for a subsequent miter cut for the corners of window or door opening, and the jig of the first embodiment is a double end jig panel with a 45° angle on each end of the jig panel and in a second embodiment a 450° on only one end of each jig of a left and a right hand panel and a runner the depth of which on the wall side of the jig of both the first and second embodiment provides a margin between the window or door opening and the trim edge, or in other words provides the set-back of the trim from the window or door opening edge, and the trim board fits into a lengthwise channel on the wall side of the jigs, for marking of the trim board for subsequent miter cut.

The second embodiment is for separate left and right jig panels, while the first embodiment is a double end jig panel assembly, each of which can be used as right or left side for marking of the window/door trim board.

OBJECTS OF THIS INVENTION

One of the objects of this invention is to disclose jigs double end and single end jigs and each jig having a channel for holding wood trim on a window/door opening for marking the wood trim for subsequent miter cut for the corners of trim around the window/door opening.

Another object of this invention is to disclose a method for a guide for marking, or scribing, window/door trim for subsequent miter cut of the window/door trim around the window/door opening.

Another object of the invention is to describe means for holding window/door trim in a channel in the jigs which means is a bolt and nut to adjust the channel opening for variance in width of the wood trim.

In the following disclosure, "window/door" opening is synonymous with "window or door opening".

"Lengthwise" means the length of either the single or double jigs.

PRIOR ART CITED (U.S. PATENTS)

U.S. Pat. No. 5,669,192 for DOOR FRAME CLADDING.

U.S. Pat. No. 5,305,566 for REPLACEMENT DOORS AND WINDOWS.

U.S. Pat. No. 5,088,682 for FACIA INSTALLATION HOLDER.

U.S. Pat. No. 4,793,109 for FACING WOODEN DOOR FRAMES.

U.S. Pat. No. 4,556,205 for GAUGING TOOL.

U.S. Pat. No. 4,308,692 for DOOR FRAME KIT.

U.S. Pat. No. 3,753,556 for DOOR JAM JIG.

None of the above prior art patents cited disclose either singly or collectively, the matter disclosed and claimed in this application for patent.

BRIEF DESCRIPTION OF DRAWINGS

FIG. 1—Wall side of double end jig for window/door trim mark for corner miter cut.

FIG. 2—Cross section view of jig for window/door trim mark for corner miter cut.

FIG. 3—Cross section of window/door trim of Oak Tear Drop, or Ranch casing.

FIG. 4—Cross section view of jig for window/door trim mark, and trim of Oak Tear Drop fitting in jig channel.

FIG. 9—Wall side face of left side single end jig for window/door trim marking for miter cut.

Figure 5:
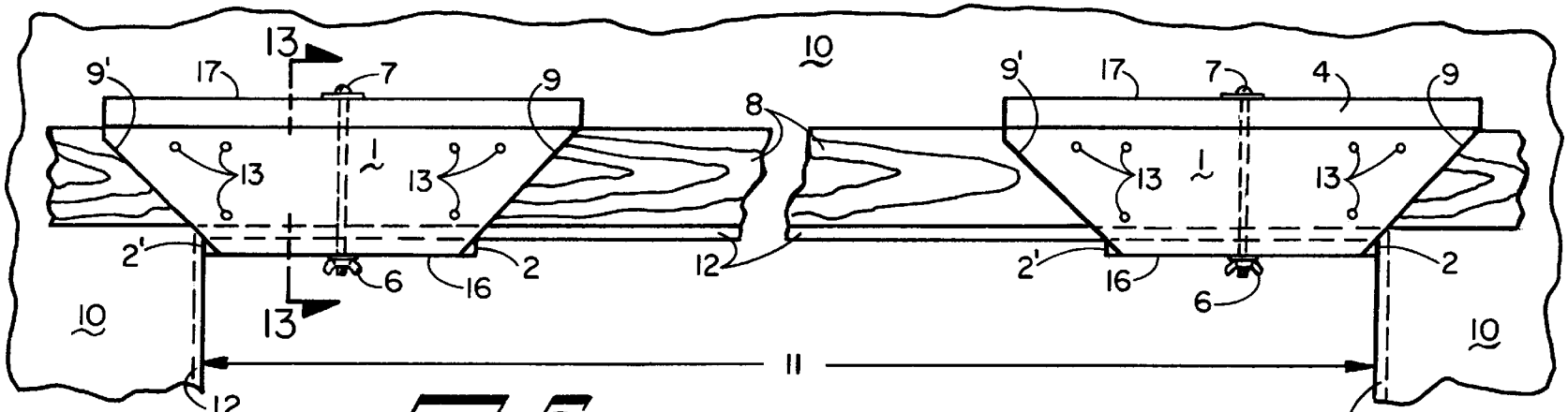
FIG. 5—Elevation view of double end jigs in position for marking for miter cut on window/door trim FIG. 6—Room side face of right side single end jig for window/door trim marking for miter cut.
Figure 10:
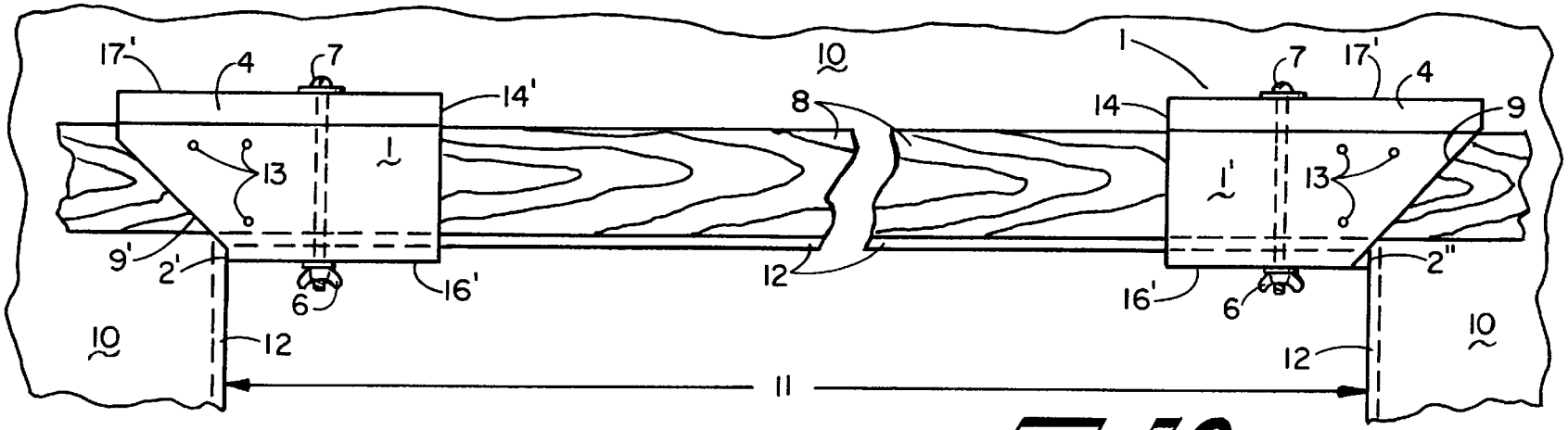
FIG. 10—Elevation view of single end jigs in position for marking for miter cut on window/door trim.
Figure 11:
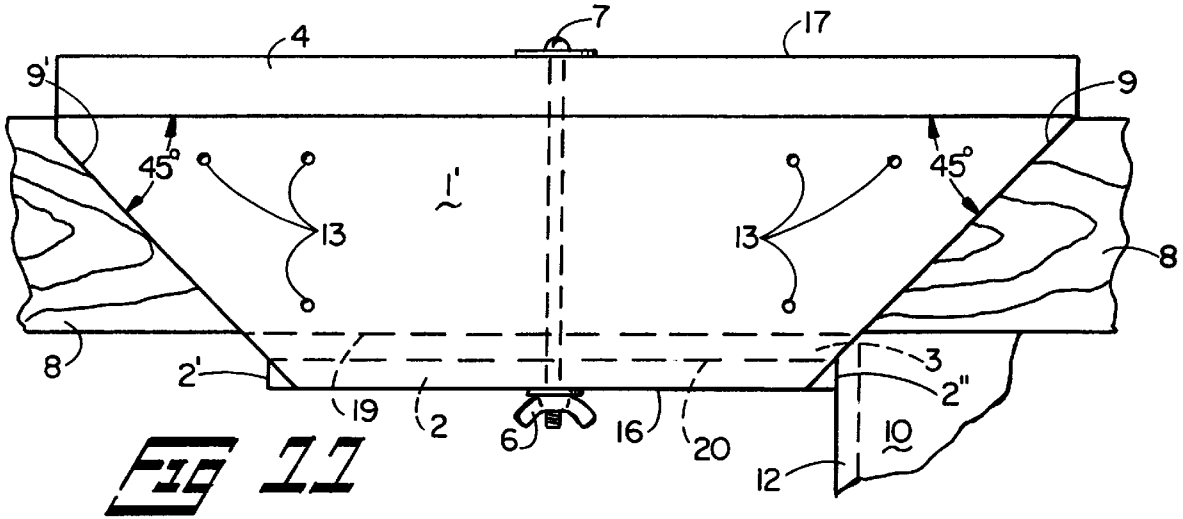
FIG. 11—Room side of double end jig for window/door trim mark for corner miter cut.

Double end jigs are shown in FIGS. 1, 5, and 11 and single end jigs are shown in FIGS. 6, 7, 8, 9, and 10 and FIGS. 2, 3, 4, 12, 13 and 14 show components in common to both the double end and single end jig assemblies.

DRAWING LEGENDS

1—Double end jig panel assembly.
1'—Jig panel room side.
1"—Jig panel wall side.
2—Runner for jig panel window/door opening.
2', 2"—Jig panel trim runner bumpers.
3—Jig panel trim support runner.
4—Jig trim guide runner.
5—Cross section of wood trim stock. (Oak tear drop or ranch casing)
6—Wing nut.
7—Threaded bolt.
8—Facing of wood trim stock: (Oak teardrop or ranch casing)
9, 9'—Guide edge for marking trim for miter cut.
10, 10'—Wall surround of window/door opening.
11—Window/door opening.
12—Set-back or margin between window/door trim strip edge and edge of window/door opening.
13—Hole or aperture for trim mounting nails.
14—Second embodiment single end right side 45° jig panel.
14'—Second embodiment single end left side 45° jig panel.

15—Jig lengthwise channel for window/door wood trim stock on wall side of jigs.
16, 16'—Bottom edge of panels.
17, 17'—Top edge of panels.
18—Thick side wall of channel 15.
18'—Thick edge of wood trim stock.
19—Narrow side wall of channel 15.
19'—Thin edge of wood trim stock.
20—Edge of runner 2 of jig panel to abut window/door opening edge.

DETAILED DESCRIPTION OF INVENTION.

In the drawing Figures, like reference numerals indicate like parts.

This invention discloses apparatus of and method for jig guide edges for marking or scribing window or door trim for subsequent miter cuts of the trim to be mounted around the window/door opening, and there are two embodiments disclosed, One or first embodiment is for a double end jig panel assembly as shown in FIGS. 1, 5, and 11, and the second embodiment is shown in FIGS. 6, 7, 8, 9, and 10. and disclosures in common for both embodiments are shown in FIGS. 2, 3, 4, and 12.

Referring now to FIG. 1 a double end jig panel assembly 1 is shown and each end of the jig panel assembly 1 having a 45° 9, 9' guide edges extending upward and outward from the bottom edge 16 of the panel 1. A jig trim guide runner 4, mounted as the top edge 17 of jig panel assembly 1, and the jig trim guide runner 4 extending the length of the top 17 and extending outward on the wall side 1" of the panel 1 and a jig panel trim support runner 3 mounted on the wall side 1" of the panel 1.

To define the terminology, "wall side" means the side 1" of the jig panel assembly facing the wall when using the jig panel assembly 1 for marking the facing of wood trim stock 8. "Room side" of the jig panel assembly is indicated 1' see FIGS. 2, 4, 5 and 11.

The words "trim", "wood trim stock" and "wood trim" are synonymous and all mean the same thing in this description.

A runner 2 for jig panel trim window/door opening along the bottom edge of the panel FIGS. 1, 2, and 4, forming a ridge extending outward further on the wall side of the panel than the jig panel trim support runner 3 and, a bolt 7 FIGS. 1, 2, 4, 5, 6, 7, 8, 9, 10, 11 extending edgewise, from top to bottom through jig panel assembly 1, 14, and 14' and a wing nut 6 mounted on bolt 7.

The edge 20, of runner 2 of the jig panel 1, 14 or 14' abuts the edge of wall surround 10 of window/door opening. (see FIGS. 13 and 14)

Reference is now made to FIGS. 2, 3, 4 and 12 which show cross sections of both embodiments of the jig assemblies 1, 14, and 14' and typical wood trim 5 cross section. On using the jig assembly 1 reference is made to FIG. 5, with double end jigs 1 fitting over wood trim and the facing 8 of the wood trim, as shown, and the wall surround 10, 10' of the window/door opening 11, and the set back 12 or margin between the window/door trim 8 strip edge and the edge of the window/door opening 11.

It is to be pointed out that the description speaks to the mounting of the trim at the top of the window/door opening, showing the left and right corners, but the jigs are to be used on all sides of the openings, for marking all corners of the trim for subsequent miter cuts.

Provision is made for holes or apertures 13 in the jigs for nails for attaching the trim to the wall of the openings.

Figure 7:
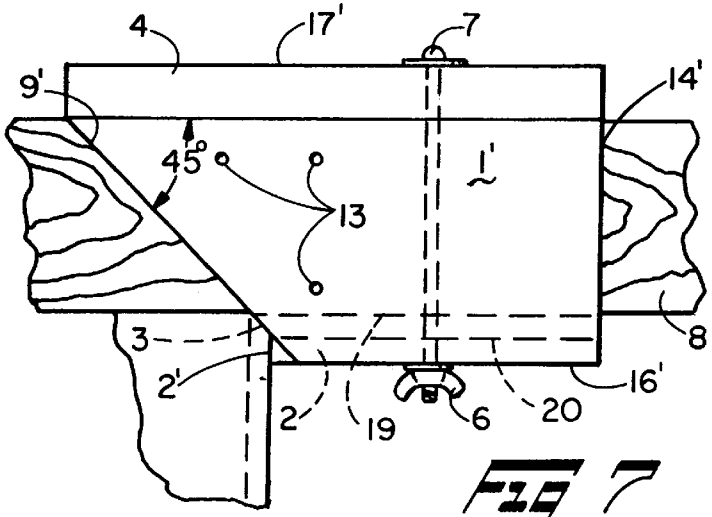
FIG. 7—Room side face of left side single end jig for window/door trim marking for miter cut.
Figure 6:
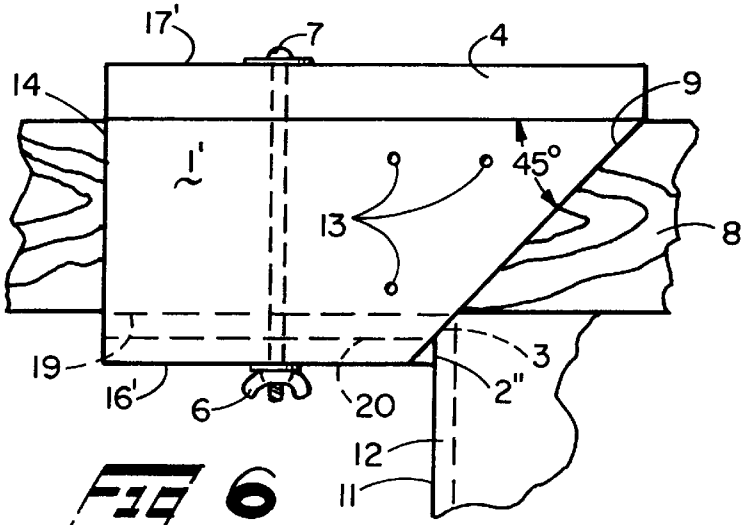
Figure 6:
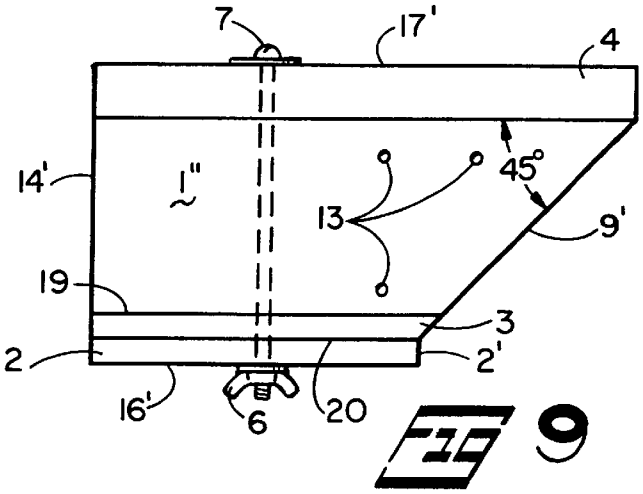
Figure 8:
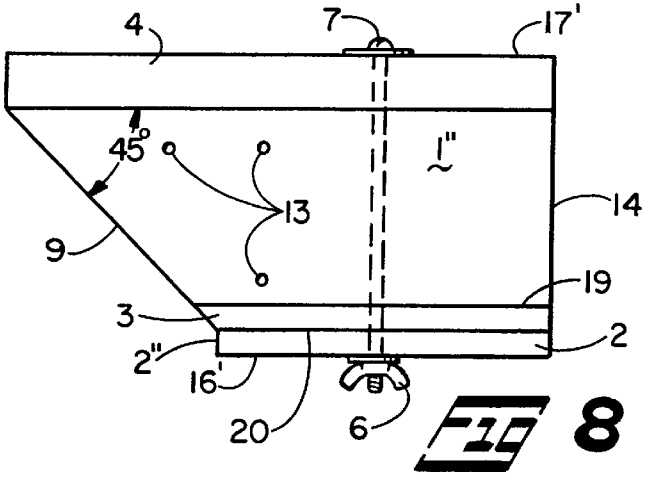
FIG. 8—Wall side face of right side single end jig for window/door trim marking for miter cut.

The above discussion mainly pertains to double end jigs however another embodiment is disclosed of single edge jig panels as shown in FIGS. 6, 7, 8, and 9 which shows a second embodiment of single end right side 45° jig panel 14 apparatus as shown in FIGS. 6 (room side) and wood trim 8 (wall side) and a guide edge 9 for marking or scribing window/door wood trim stock for subsequent miter cut of corners of the wood trim stock 8. FIGS. 7 and 9 show the room side and wall side of left hand side single end jig 14'. The single end jigs for left and right corners are mirror images of each other and are to function in the same way as the double end jigs.

In a single end jig panel 14, 14', the end of the jig panel having a 45° cut extends upwards from the edge 20 of the panels 14, 14'.

Figure 12:
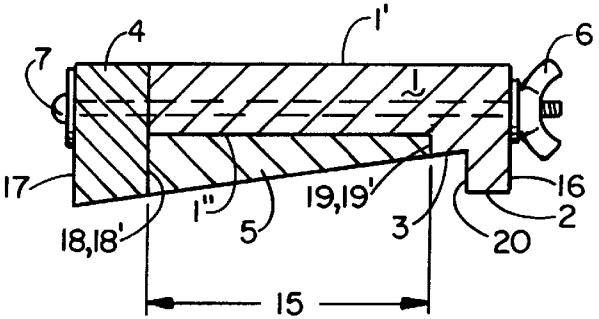
FIG. 12—Cross section view of jig for window/door trim mark, and trim of Oak Tear Drop fitting in alternate jig channel.

Mounted on the top of both embodiments of the jig panels 14, 14' is a jig trim guide runner 4 extending the length of the top and extending sideways outward on the wall side of the panels, FIGS. 2, 4 and 12. A jig panel trim support runner 3 mounted on the wall side 1" of the panel 14 and a runner 2 for jig panel trim window/door opening along the bottom edge of the panel and this runner 2 forming a ridge extending outward further on the wall side of the panel 14 and 14' than the jig panel trim support runner 3 and, a threaded bolt 7 extending through the jig trim guide runner from top to bottom of the panel, for both of the double and single end jig panels, as shown in all of the Figures, and a wing nut 6, mounted on the bolt 7.

The jigs of this invention serve to accurately provide a guide edge 9, 9' for marking wood trim for a subsequent miter cut and to provide a uniform set back of the trim stock 8 from the edge of the window/door opening 11 when the jigs are used on marking the trim on all four sides of the window/door opening for subsequent miter cuts of the corners.

Referring now to FIGS. 6 and 11, jig panel runner bumper 2" which is the right end of runner 2 for jig panel trim window/door opening abuts edge of window/door opening 11, and the trim 8 supported on 3, jig panel trim support runner then gives a uniform set back or margin 12 between window/door wood trim 8 edge and edge of window/door opening 11. FIGS. 7 and 9 for left end 2' of runner 2 to abut the left side (see FIG. 10) of the window /door opening 11 for marking of the wood trim stock, on both right and left sides of the window/door opening 11.

Reference is now made to FIGS. 5 and 10 to show the layout of each of the jig embodiments for providing a guide for marking window/door trim for subsequent miter cut for corners of window/door wood trim mounting, to give a uniform set back,or margin of the trim from the window/door opening.

FIG. 12 is a cross section view of jig for window/door trim marking for subsequent miter cut, and the trim of Oak tear drop fitting in alternate channel 15 of any of above disclosed jigs, either double or single.

Figure 13:
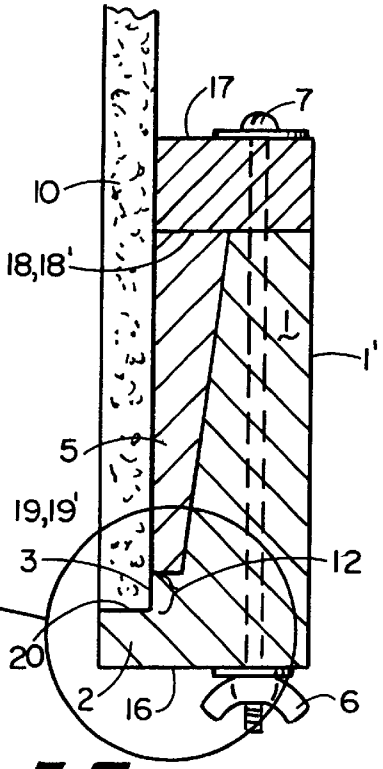
FIG. 13—Cross section view of double end or single end jig and wood trim held in channel and assembly held against the wall, over window/door opening.

FIG. 13 is a cross section view of double end jig and wood trim 8 held in channel 15 and the whole assembly held against the wall 10 over the window/door opening 11, and this cross section view is indicated in FIG. 5.

Figure 14:
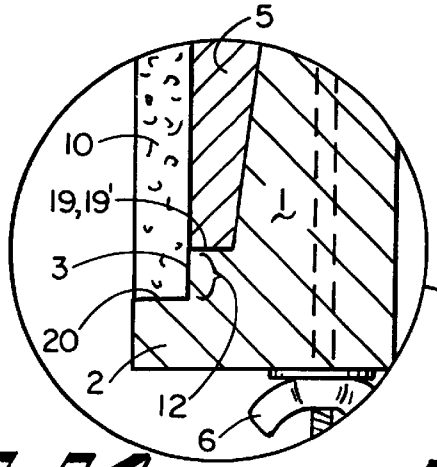
FIG. 14—Enlarged view of segment of FIG. 13.

FIG. 14 is an enlarged view of a segment of FIG. 13 to show the margin or set back of the trim 8 from the edge of the window/door opening. This segment enlarged showing the set back applies to both embodiments of the jigs disclosed, and shows the set back or margin 12 between the window/door trim strip and the edge of the window/door opening and is a function of the height of jig panel trim support runner 3.

Reference is now made to FIGS. 2, 3, 4 and 12 to show the jig lengthwise channel 15 for the window/door wood trim on the wall side of the jigs, and the thick edge 18' of the wood trim and the thin edge 19' fitting in jig lengthwise channel 15, with the thick edge 18' of the wood trim stock abutting thick wall 18 of the channel 15, and the thin edge 19' of the wood trim stock abutting the thin wall 19 of the lengthwise channel, and the jig with the wood trim stock fitting in the lengthwise channel 15 is flush with the jig panel trim support runner 3, and trim jig guide runner 4.

The threaded bolt 7 and wing nut 6 attached thereto serves to allow for adjustment of the channel 15 width to compensate for variance in width of the wood trim 8, and to manipulate the jigs on the wood trim for marking the wood trim for subsequent miter cuts for the corners of the trim surrounding the window/door opening

What is claimed is:

1. A jig panel apparatus for a guide for marking window/door wood trim for subsequent miter cut of corners of said wood trim surrounding a window/door opening comprising;

a—a double end jig panel and each end of said jig panel having a 45° cut extending upwards from the bottom edge of said panel, b—a jig trim guide runner mounted on the top of said jig panel, and said jig trim guide runner extending the length of said top and extending outward on the wall side of said panel;

c—a jig panel trim support runner mounted on said wall side of said panel;

d—a channel extending lengthwise between said jig panel trim support runner and said jig trim guide;

e—a runner for jig panel trim window/door opening along the bottom edge of said panel and said runner forming a ridge extending outward further on the wall side of said panel than said jig panel trim support runner and, f—a bolt extending through said jig trim guide runner and said panel and a nut mounted on said bolt.

2. Jig panel apparatus for a guide for marking window/door wood trim for subsequent miter cut of corners of said wood trim surrounding window/door opening comprising;

a—a single end jig panel, one for left hand and one for right hand and are mirror images of each other, said end of said jig panels having a 45° cut extending upward from the bottom edge of said left or right panel;

b—a jig trim guide runner mounted on the top of each of said jig panels, and said jig trim guide runner extending the length of said top and extending outward on the wall side of said panels;

c—a jig panel trim support runner mounted on said wall side of said panels;

d—a channel extending lengthwise between said jig panel trim support runner and said jig trim guide;

e—a runner for jig panel trim window/door opening along the bottom edge of said panel and said runner forming a ridge extending outward further on the wall side of said panel than said jig panel trim support runner and, f—a bolt extending through said jig trim guide runner and said panel and a nut mounted on said bolt.

3. A jig panel apparatus of claim 1 for a guide for marking window/door wood trim for subsequent miter cut of corners of said wood trim surrounding a window/door opening said double end jig panel further comprising;

a—width of said wood trim fitting in width of said lengthwise channel.

4. A jig panel apparatus of claim 2 for a guide for marking window/door wood trim for subsequent miter cut of corners of said wood trim surrounding a window/door opening said single end jig panel further comprising;

a—width of said wood trim fitting in width of said lengthwise channel.

5. A jig panel apparatus for a method for a guide for marking window/door wood trim for subsequent miter cut of corners of said wood trim surrounding a window/door opening comprising;

a—a double end jig panel and each end of said jig panel having a 45° cut extending upwards from the bottom edge of said panel, b—a jig trim guide runner mounted on the top of said jig panel, and said jig trim guide runner extending the length of said top and extending outward on the wall side of said panel;

c—a jig panel trim support runner mounted on said wall side of said panel;

d—a channel extending lengthwise between said jig panel trim support runner and said jig trim guide;

e—a runner for jig panel trim window/door opening along the bottom edge of said panel and said runner forming a ridge extending outward further on the wall side of said panel than said jig panel trim support runner and, f—a bolt extending through said jig trim guide runner and said panel and a nut mounted on said bolt.

g—holding one jig at the left hand corner and one jig at the right hand corner of the window/door opening with said wood trim in said channel of each of said jigs and, h—marking or scribing a mark on said wood trim on the left side guide edge of said left jig and on the right side guide edge of said right side jig.

6. Jig panel apparatus method of a guide for marking or scribing window/door wood trim for subsequent miter cut of corners of said wood trim surrounding window/door opening comprising;

a—a single end jig panel, one for left hand and one for right hand and are mirror images of each other, said end of said jig panels having a 45° cut edge extending upward from the bottom edge of said left or right panel;

b—a jig trim guide runner mounted on the top of each of said jig panels, and said jig trim guide runner extending the length of said top and extending outward on the wall side of said panels;

c—a jig panel trim support runner mounted on said wall side of said panels;

d—a channel extending lengthwise between said jig panel trim support runner and said jig trim guide;

e—a runner for jig panel trim window/door opening along the bottom edge of said panel and said runner forming a ridge extending outward further on the wall side of said panel than said jig panel trim support runner;

f—a bolt extending through said jig trim guide runner and said panel and a nut mounted on said bolt;

g—holding said left hand jig at the left hand corner and said right hand jig at the right hand corner of said window/door opening and said wood trim in said channel in each of said jigs and, h—marking or scribing a mark on said wood trim on the left side guide edge of said left side jig, and on the right side guide edge of said right hand jig.

* * * * *